US006076912A

United States Patent [19]

Murthy

[11] Patent Number: 6,076,912

[45] Date of Patent: Jun. 20, 2000

[54] THERMALLY CONDUCTIVE, CORROSION RESISTANT PRINTHEAD STRUCTURE

[75] Inventor: Ashok Murthy, Lexington, Ky.

[73] Assignee: Lexmark International, Inc., Lexington, Ky.

[21] Appl. No.: 09/089,713

[22] Filed: Jun. 3, 1998

[51] Int. Cl.[7] ..... B41J 29/377

[52] U.S. Cl. ..... 347/18; 347/50; 347/65

[58] Field of Search ..... 347/63, 65, 18, 347/50

[56] References Cited

U.S. PATENT DOCUMENTS

| | | | |
|---|---|---|---|
| 4,727,384 | 2/1988 | Tsuda | 346/140 R |
| 4,935,750 | 6/1990 | Hawkins | 346/140 R |
| 4,942,408 | 7/1990 | Braun | 346/140 R |
| 4,949,102 | 8/1990 | Braun | 346/140 R |
| 5,016,023 | 5/1991 | Chan et al. | 346/1.1 |
| 5,160,577 | 11/1992 | Deshpande | 156/644 |
| 5,408,738 | 4/1995 | Schantz et al. | 29/611 |
| 5,459,498 | 10/1995 | Seccombe et al. | 347/18 |
| 5,594,481 | 1/1997 | Keefe et al. | 347/65 |
| 5,625,396 | 4/1997 | Keefe et al. | 347/84 |

*Primary Examiner*—John E. Barlow, Jr.
*Assistant Examiner*—Michael S. Brooke
*Attorney, Agent, or Firm*—Michael T. Sanderson

[57] ABSTRACT

The invention described in the specification relates to a carrier for an ink jet printhead having unique characteristics which substantially inhibit corrosion and provide improved thermal heat transfer from energizer devices for the ink to the surrounding atmosphere. The carrier has top and bottom surfaces and is adapted to receive a chip and a circuit layer thereon. Another feature of the carrier is a well having a base and walls surrounding the base for receiving a semiconductor chip therein. The walls extend above the top surface of the carrier to a wall height that is substantially equal to the thickness of the circuit layer. The well has a well depth that is substantially equal to the thickness of the chip. A slot formed in the base of the well extends from the bottom surface of the carrier to the base and provide a flow path for ink to the energizers on the chip. Use of a separate carrier for the printhead components provides increased process versatility during the manufacture of the printhead.

26 Claims, 3 Drawing Sheets

THERMALLY CONDUCTIVE, CORROSION RESISTANT PRINTHEAD STRUCTURE

FIELD OF THE INVENTION

This invention relates to the field of printing. More particularly the invention relates to ink jet printhead structures which provide improved corrosion resistance.

BACKGROUND OF THE INVENTION

Ink jet printers form an image on a substrate by ejecting drops of ink from a cartridge assembly toward a substrate, which is typically a paper media. The ink drop is ejected through a nozzle by an ink energizer on a semiconductor chip. The energizer may be a device such as a heater or a piezoelectric device. The ink energizer works by receiving an electrical current and transforming the energy in the electrical current into a pressure pulse or heat, some of which is transferred into the ink causing the ink to be ejected through the nozzle toward the print media. Much of the energy from the electrical current provided to the chip ends up as heat.

Not all of the heat produced by the energizer is transferred into the portion of the ink that is immediately ejected from the nozzle. Some of the ink which receives the heat remains in the area of the printhead adjacent the chip or in the ink reservoir. The heat in the components also tends to be transferred to the ink remaining in the printhead or in the ink reservoir. If the ink remaining in the printhead receives the excess heat at a sufficiently small rate, then the ink is able to dissipate the heat through other components of the printhead or ink reservoir. However, if the ink remaining in the printhead or reservoir receives heat at a rate above that at which the heat can be dissipated, then the temperature of the ink may rise excessively. This increase in ink temperature can cause problems with the functioning of the cartridge.

For example, as the temperature of the ink increases, dissolved gases in the ink will tend to separate from the ink, and form gas bubbles. The bubbles act as obstructions in the flow channels of the cartridge, blocking the flow of ink to the nozzles and reducing print quality. In addition, the change in ink temperature, further compounded by the separation of dissolved gases from the ink, tends to change the viscosity of the ink. This affects the mass and velocity of the ink drops that are ejected from the nozzles, and again, reduces print quality. Thus, for these and other reasons, controlling heat transfer within the printhead tends to be a very important consideration in ink jet printhead design.

Other printhead design considerations tend to exacerbate the problem of ink heating, rather than alleviate it. For example, consumers prefer printers that operate faster. One common method of achieving this design goal is to fire the energizers at a faster rate and produces smaller ink droplets. A faster firing rate puts heat into the ink at a faster rate. Thus, the printhead components tend to heat up and warm the ink remaining in the printhead.

Furthermore, printers having a higher print resolution are more preferred. One method of achieving this design goal is to place the energizers closer together, so that more ink droplets can be formed within in a given surface area. Each of the ink droplets may also be smaller. Not only does an increase in energizers increase the printhead and ink temperatures, but smaller ink droplets tend to transfer heat away from the printhead with much less efficiency than the heat transferred by larger ink droplets. Thus, some preferred design goals tend to increase the problem of ink and printhead component heating.

Some ink jet printheads have been designed to dissipate heat in a more efficient manner. However, these cartridges typically require complicated assembly methods and customized parts which tend to increase printers costs significantly. Further, these complex printheads tend to use components which are not sufficiently resistant to ink induced corrosion. Accordingly as the components are exposed to the ink, corrosion of the components may cause the components to fail or the ink to be contaminated.

An object of the invention is to provide an improved printhead assembly for an ink jet printer.

Another object of the invention is to provide a printhead assembly which is cost effective to make.

Still another object of the invention is to provide a printhead of improved design which more effectively removes excessive heat from the printhead assembly.

Another object of the invention is to provide a printhead assembly which reduces the exposure of various components to corrosive materials.

Yet another object of the invention is to provide a printhead structure suitable for use with higher energy higher speed printhead.

SUMMARY OF THE INVENTION

The above and other objects are provided by a carrier for an ink jet printhead having top and bottom surfaces, the carrier being adapted to receive a chip and a circuit layer each having a thickness. The carrier has a well with a base and walls surrounding the base. The walls extend above the top surface of the carrier to a wall height that is substantially equal to the thickness of the circuit layer. The well has a well depth that is substantially equal to the thickness of the chip. One or more slots formed in the base of the well extend from the bottom surface of the carrier to the well base.

In another aspect the invention provides a method of forming an ink jet print head. In the method, an ink reservoir, a semiconductor chip, a circuit layer, a nozzle plate, and a carrier are formed. The chip has a thickness, a carrier attachment surface, a device surface opposite the attachment surface, and energizers disposed on the device surface. The circuit layer has a thickness, a bottom surface, a top surface opposite the bottom surface, and contacts for making electrical connections to the circuit layer. The nozzle plate has a flow feature surface, print media surface opposite the flow feature surface, and nozzle holes extending from the flow feature surface to the print media surface.

An important feature of the invention is the substrate carrier. The carrier has an ink supply surface, a substrate surface, at least one well in the substrate surface having a base with an adhesive surface for attaching the semiconductor chip thereto, and walls surrounding the base. The walls extend above the substrate surface of the carrier to a wall height which is substantially equal to the thickness of the circuit layer attached to the substrate surface of the carrier. The well has a well depth that is substantially equal to the thickness of the semiconductor chip. Two slots formed in the base of the well extend from the ink supply surface of the carrier to a portion of the base that is adjacent the adhesive surface of the base for a side feed configuration. For a center feed configuration, at least one slot extends through a portion of the adhesive surface of the base.

The energizers of the chip are aligned with the nozzles of the nozzle plate, and the device surface of the chip is attached adjacent to flow feature surface of the nozzle plate which nozzle plate is also attached to the walls. The bonding surface of the chip is attached to the adhesive surface of the base, and the bottom surface of the circuit layer is attached to the substrate surface of the carrier. An ink reservoir or ink supply is attached to the ink supply surface of the carrier such that the slot in the base of the well provides fluid flow communication between the well and the ink reservoir. Contacts of the circuit layer are electrically connected to the chip in order to provide an activation signal to the energizers on the chip.

The foregoing presents a unique printhead design which effectively conducts heat away from the printhead while protecting critical components from corrosion. The heat is conducted away from the energizers by the chip through any one or more of several different paths. For example, the heat can be transferred from the chip to the carrier through the adhesive surface at the base of the well. From the carrier, the heat can be dissipated to the air as by the use of cooling fins on the carrier. Additionally, the heat can be transferred from the chip to the nozzle plate, where it can again be dissipated to the air. The ink flow to the chip may also conduct heat away the chip.

Preferably, a thermally conductive adhesive is used to attach the carrier attachment surface of the chip to the adhesive surface of the base. The use of the thermally conductive adhesive further improves the ability of the chip to conduct heat away from the energizers and into the carrier.

In the preferred embodiment, the adhesive is cured at an adhesive curing temperature prior to the step of attaching the circuit layer to the carrier and prior to attaching the carrier to the ink reservoir. Preferably, the carrier chip and nozzle plate are all formed of materials that are substantially resistant to the adhesive curing temperature. In this manner, components which are not designed to withstand the curing temperature may be attached to the printhead structure after the adhesives are cured. Thus, standard components may be used for the ink reservoir and the circuit layer, and the cost of the cartridge is reduced.

Another advantage of the invention is that the carrier, chip, and nozzle plate are all formed of materials or coated with materials that are substantially resistant to ink induced corrosion, thus extending the life of the printhead and maintaining the purity of the ink. Preferably, the carrier is made of a metal matrix composite, a polymer matrix composite, a metal, or a metal alloy. A particularly preferred carrier is made of metal or a metal alloy having a relatively high thermal conductivity coefficient.

The components attached to the carrier are effectively protected from corrosion during printing operations by the design features of the carrier. For example, corrosion protection is provided by the well walls which extend above the top surface of the carrier to provide a cavity or well for the semiconductor chip. Since the nozzle plate is sealed to the top of the well walls with an adhesive, ink flowing to the chip is confined substantially in the well.

The circuit layer is confined to the region or area surrounding the wells also by the well walls. Since no part of the circuit layer is in contact with the ink in the wells, there is significantly less corrosion of the circuit layer.

BRIEF DESCRIPTION OF THE DRAWING

Further advantages of the invention will become apparent by reference to the detailed description of preferred embodiments when considered in conjunction with the drawings, in which.

DETAILED DESCRIPTION OF THE INVENTION

Figure 1:
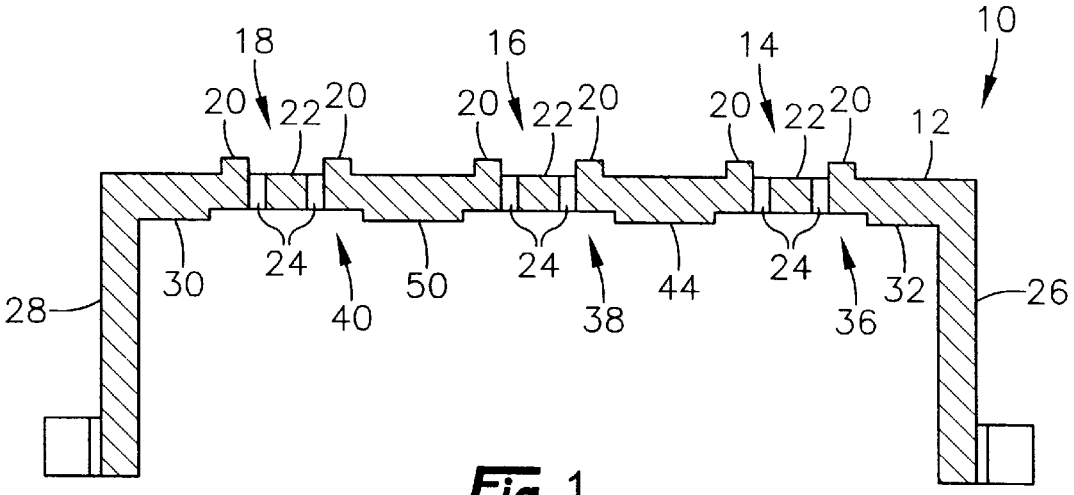
FIG. 1 is a cross-sectional view, not to scale of a chip carrier nose piece according to the invention.

Referring now to the figures, there is depicted in FIG. 1, a cross-sectional view of a chip carrier or nosepiece 10 according to the invention. The chip carrier 10 is preferably a one-piece construction and is made of a cast, machined or molded material having a first surface 12 containing one or more wells 14, 16 and 18, each well having well walls 20 and a well base 22. The carrier also preferably contains side walls 26 and 28 which are adjacent and preferably attached to the first surface 12 along the perimeter thereof. The chip carrier 10 may be made of a variety of materials including composite materials made of carbon fibers, graphite, metal-ceramic materials and metals. The preferred material for the chip carrier is a metal material selected from aluminum, beryllium, copper, gold, silver zinc, tungsten, steel, magnesium and alloys thereof.

The carrier 10 is preferably formed of a material that both conducts heat well and is relatively resistant to corrosion induced by the ink. Another important characteristic of the material from which the carrier 10 is formed is that it is able to withstand curing temperatures for adhesives used to attach components of the printhead to one another. Materials which can withstand the adhesive cure temperature and conduct heat well, but which are not resistant to corrosion, can also be used if they are first coated with a corrosion protection material such as poly(xylelene) available from Specialty Coating Systems of Indianapolis, Ind. under the tradename PARYLENE or silicon dioxide. The coating thickness may range from about 1 to about 20 microns.

A description of poly(xylelenes), the processes for making these compounds and the apparatus and coating methods for using the compounds can be found in U.S. Pat. Nos. 3,246,627 and 3,301,707 to Loeb, et al. and U.S. Pat. No. 3,600,216 to Stewart, all of which are incorporated herein by reference as if fully set forth.

Another preferred coating which may be used to protect a metal carrier or metal composite carrier is silicon dioxide in a glassy or crystalline form. An advantage of the silicon dioxide coating over a poly (xylelene) coating is that silicon dioxide has a higher thermal conductivity than poly (xylelenes) and thus a greater coating thickness can be used. Another advantage of silicon dioxide is that it provides a surface having high surface energy thus increasing the adhesiveness of glues or adhesives to the coated surface. The coating thickness of the silicon dioxide coating ranges from about 2 to about 12 microns.

A carrier may be coated with silicon dioxide by a spin on glass (SOG) process using a polymeric solution available from Allied Signal, Advanced Materials Division of Milpitas, Calif. under the tradename ACCUGLASS T-14. This material is a siloxane polymer that contains methyl groups bonded to the silicon atoms of the Si—O polymeric backbone. A process for applying a SOG coating to a substrate is described, for example, in U.S. Pat. No. 5,290,399 Reinhardt and U.S. Pat. No. 5,549,786 to Jones et al. incorporated herein by reference as if fully set forth.

The carrier may also be coated with silicon dioxide using a metal organic deposition (MOD) ink which is available from Engelhard Corporation of Jersey City, N.J. The MOD ink is available as a solution in an organic solvent. The MOD process is generally described in U.S. Pat. No. 4,918,051 to Mantese et al. After coating the carrier, the coating is dried and fired to bum off the organic component leaving silicon that reacts with oxygen to form silicon dioxide or other metal silicates on the surface of the carrier.

Polymeric materials such as phenol-formaldehyde resins and epoxies may also be applied to the carrier to protect the carrier from corrosion. Such materials are generally applied from an aqueous or organic solution or emulsion containing the polymeric material. Any of the foregoing corrosion protection materials may be applied to the carrier using a variety of techniques including dipping, spraying, brushing, electrophoretic processes. An electrostatic process for applying the corrosion protection material as a dry powder may also be used to coat the carrier.

Regardless of the coating and coating technique used, it is preferred to use a coating and coating process which provides a layer of the coating having a thickness that is substantially uniform over the entire carrier. The coating should be adaptable to intricate shapes and features of the carrier so that there is essentially no uncoated surface of the carrier. The selected coating also should be chemically inert with respect to the ink and provide a substantially impervious layer which resists migration or water or ink components through the coating to the carrier.

The wells 14, 16 and 18 of carrier 10 define the location of one or more semiconductor substrate chips which are adjacent and preferably attached to the adhesive surface of the carrier at the base 22 of the wells 14, 16 and 18 preferably by means of a heat conductive adhesive such as a metal-filled or boron nitride filled adhesive having a conductivity of ranging from about 1 to about 10 watts per meter–°K.

The walls 20 of the wells 14, 16 and 18 rise to a wall height above the first surface 12 of the carrier 10 (FIG. 1) that is outside of the wells 14, 16 and 18. The term "wall height" is defined as the distance between the top of the walls 20 and the surface of the carrier 10 outside of the walls 20, or in other words, outside of the wells 14, 16 and 18. The wall height may be different than the well depth. Although the well depth and the wall height are depicted as being almost the same in the figures, the base 22 of the wells 14, 16 and 18 may lie in a plane that is above, below, or the same as a plane defined by the first substrate surface 12 of the carrier 10 outside of the wells 14, 16 and 18.

The size of each well 14, 16 and 18 is preferably such that it can accommodate semiconductor chips ranging in size from about 2 to about 4 millimeters wide and from about 3 inch to about 2 inch long or longer, depending on the ability to produce longer chips. Each well 14, 16 and 18 contains at least one aperture or ink feed slot 24 in the bottom or base 22 of the wells 14, 16 and 18 thereof which enables ink from an ink reservoir to flow to the energy imparting areas of the chips or substrates either around the edges of the chips, in the case of two apertures, or through generally centrally located vias in the chips, in the case of only one aperture. The energy imparting areas of the chips may be provided as by resistive or heating elements which heat the ink or piezoelectric devices which induce pressure pulses to the ink in response to a signal from a printer controller.

The well depth and the wall height are specifically selected, and the carrier 10 is specifically manufactured in support thereof, to achieve two specific design goals. The well depth is selected so that the chip extends from a nozzle plate at the top of the walls 20 to an adhesive surface at the base 22 of the wells 14, 16 and 18. Accordingly, wells 14, 16 and 18 have a well depth which is substantially equal to the thickness of the chip. The term "well depth" means the distance from the top of the walls 20 to the base 22 of the wells 14, 16 and 18. By "substantially equal" it is meant that when the chip and nozzle plate have been attached to the carrier 10, the chip extends from, and is in intimate thermal contact with an adhesive at the top of the walls 20, and an adhesive between bonding surface at the base 22 of the wells and the chip.

The thickness of the chip may vary, but is known from design to design, and typically ranges from about 0.3 to about 1.2 millimeters. Thus, the well depth ranges from at least about 0.3 to about 1.2 millimeters, plus an additional distance of from about 0.025 to about 0.125 millimeters to allow for the thickness of the adhesives between the chip and nozzle plate and between the chip and carrier. The value for the wall height is selected as described in more detail below.

The chip carrier 10 itself is preferably a shaped, molded or machined device which may contain cooling fins along one or more side walls 26 and 28 thereof for convective cooling of the carrier 10. The cooling fins can have a variety of shapes and orientations and are preferably machined molded or cast into the carrier 10. Separate cooling fin structures may also be fixedly attached to one or more of the other side walls of the carrier as by use of heat conductive adhesives, solder and the like.

Each well 14, 16 or 18 is associated with a corresponding chamber 36, 38 and 40 adjacent the ink supply surface of the carrier. Chamber 36 is defined by chamber wall 32 and partition wall 44. Chamber 38 is defined by partition walls 44 and 50. Chamber 40 is defined by partition wall 50 and chamber wall 30.

Figure 2:
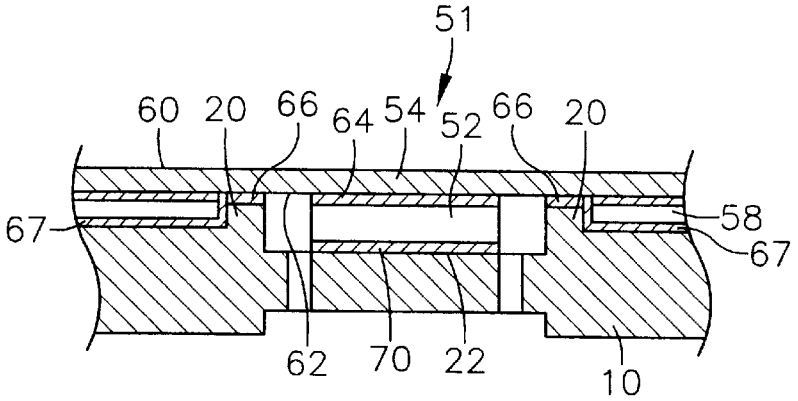
FIG. 2 is an enlarged cross-sectional end view taken through a well of a chip carrier according to the invention.

As shown by an enlarged cross-sectional view of a portion of a chip carrier (FIG. 2), the printhead structure 51 is comprised of four major components, namely, a chip carrier 10 as described above, a semiconductor chip 52, a nozzle plate 54, and a circuit layer 58. The components may each be individually manufactured according to standard manufacturing processes and methods well known to those skilled in the art, modified as described below. After the components are assembled, an ink reservoir is attached to the chip carrier 10.

The chip 52 is preferably a semiconducting device, such as one formed on a silicon substrate, and is produced using semiconductor processing techniques. Energizers are formed on the top surface of the chip 52. The energizers are preferably devices such as resistance elements or piezoelectric devices, and are most preferably resistance elements. The energizers are electrically connected to electrical contacts on the top surface of the chip 52 by electrical traces. While only one chip 52 is depicted in the figure, it will be appreciated that more than one chip 52 may be used and attached to the wells 14, 16 and 18 as described in FIG. 1 above.

The nozzle plate 54 is preferably constructed of a plastic, a metal or a metal coated material and is most preferably made of polyimide. Suitable polyimide tapes include materials available from DuPont Corporation of Wilmington, Del. under the trade name PYRALUX and from Rogers Corporation of Chandler, Ariz. under the trade name R-FLEX 1100. However, it will be understood that a printhead structure 51 in accordance with the present invention is applicable to nozzle plates 54 made of virtually any suitable material.

The nozzle plate 54 has nozzle holes which extend from the print media surface 60 of the nozzle plate 54 to the flow features surface side 62 of the nozzle plate 54 adjacent the energizers on the chip 52. The nozzle holes are formed by methods such as chemical etching, dry etching, drilling or laser ablation of the nozzle plate 54. The nozzle plate 54 typically also contains flow features on the flow feature surface side 62 thereof which allow ink to flow to the nozzle holes. The flow features may be formed by the methods described above.

The nozzle plate 54 and chip 52 are preferably attached one to another by an adhesive 64. A B-stageable thermal cure resin including, but not limited to phenolic resins, resorcinol resins, epoxy resins, ethylene-urea resins, furane resins, polyurethane resins and silicone resins is preferably used to attach the nozzle plate 54 to the chip 52. The thickness of the adhesive layer 64 preferably ranges from about 1 to about 25 microns. In a most preferred embodiment, the nozzle plate 54 is a polyimide material containing a phenolic butyral adhesive layer 64. Prior to attaching the nozzle plate 54 and chip 52 to the carrier 10, the nozzle plate is attached to the chip 52 and the adhesive 64 is cured.

An adhesive 67 may also be used between the circuit layer 58 and the carrier 10 to attach the circuit layer to the carrier. A preferred adhesive for this purpose is a phenolic butyral adhesive, an acrylic based pressure sensitive adhesive such as AEROSET 1848 available from Ashland Chemicals of Ashland, Ky. or a phenolic blend such as SCOTCH WELD 583 available from 3M Corporation of St. Paul, Minn.

After the nozzle plate 54 is attached to the chip 52, the chip/nozzle plate assembly is attached to the carrier 10 using adhesive 66 between the nozzle plate 54 and the tops of the walls 20, and an adhesive 70 between the carrier attachment surface of the chip 52 and an adhesive surface of the base 22 of the well. In a procedure wherein adhesive 64 is not cured prior to placing the nozzle plate 54 and chip 52 in the well, adhesives 66 and 64 may be the same. Adhesive 66 is preferably an acrylic based pressure sensitive adhesive such as AEROSET 1848 and adhesive 70 is preferably a die bond adhesive, such as a resin filled with thermal conductivity enhancers such as silver or boron nitride. A preferred adhesive 70 is POLY-SOLDER LT available from Alpha Metals of Cranston, R.I. and a die bond adhesive containing boron nitride fillers available from Bryte Technologies of San Jose, Calif. under the trade designation G0063.

The adhesives 64, 66, 67, and 70 are preferably cured at a temperature of from 150° C. to 200° C. The materials selected for fabrication of the chip 52, nozzle plate 54, and carrier 10, as described above, are all able to withstand these temperatures. Thus, a single cure cycle may be used to cure all of the adhesives at once thereby reducing the process steps required for curing these adhesives. Accordingly, all of the components present in the assembly at this point in the process are resistant to degradation by the adhesive cure temperature. This simplifies the manufacturing process, reduces the manufacturing costs, and increases the reliability of the printhead structure 51. Further, this allows the other components of the printhead structures 51, such as the circuit layer 58 and ink reservoir to be made of materials more adapted and selected for their individual purposes, and not for their ability to withstand elevated temperatures. It will be recognized, however, that step-wise curing of the various adhesives may also be conducted if desired.

Accordingly, a preferred assembly sequence for a printhead according to the invention would be to attach the nozzle plate 54 to the chip 52 and cure adhesive 64. Circuit layer 58 is attached to the carrier 10 using adhesive 67 prior to the nozzle pate/chip assembly being attached to the carrier with adhesive 70. When the entire printhead has been assembled, the adhesives 66, 67 and 70 are cured.

Figure 3A:
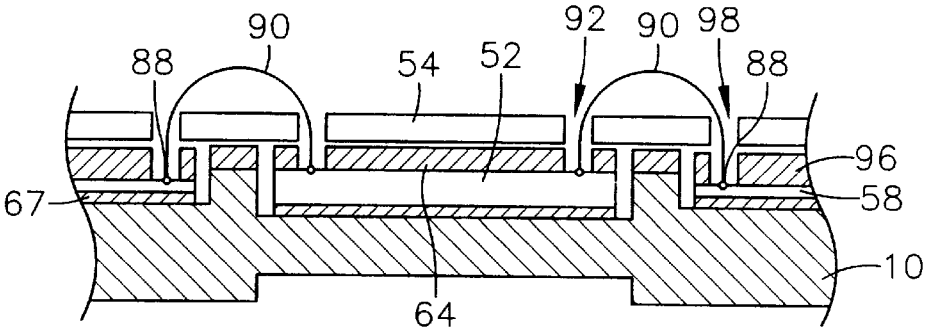
FIGS. 3A and 3B are enlarged cross-sectional side views taken through a well of a chip carrier according to the invention.
Figure 3B:
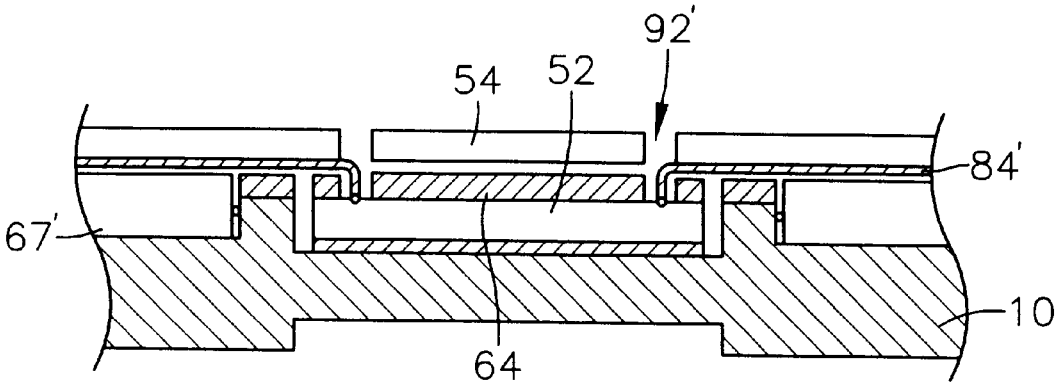

The function of the circuit layer 58 is to electrically connect to and receive electrical signals from a controller located on a printer. The circuit layer 58 receives these signals via electrical contacts on the circuit layer 58, and conducts the signals via electrical traces and wire bonds to a chip. FIGS. 3A and 3B are cross-sectional side views of an assembled nozzle plate 54, chip 52, circuit layer 58 and chip carrier 10 showing preferred methods for electrically connecting between the chip 52 and circuit layer 58.

As shown in FIG. 3A, the nozzle plate 54 and circuit layer 58 may be individually provided or may be integral with one another and are each preferably provided by a tape material, such as a polyimide polymer tape, having a thickness ranging from about 15 to about 200 microns.

Electrical traces are included on the circuit layer 58, each trace terminating at one end at a contact pad for connection to a printer carriage and at the other end with electrical contacts 88 for connection to the chip 52. The traces may be provided on the circuit layer 58 by plating processes and/or photo lithographic etching. It will be appreciated that the electrical connections as depicted in the figure are exemplary only, and the electrical connections may be accomplished according to any one or more of a number of different methods well known and understood in the art.

As shown in cross-sectional view in FIG. 3A, wires 90 are used to electrically connect the electrical traces on the circuit layer 58 to the chip 52 to enable electrical signals to be conducted from the printer to the chip 52 for selective activation of the energizing devices on the chip during a printing operation. In the case of resistance heaters being used as the energizing devices, the heaters are electrically coupled to the conductive traces via wires 90.

During a printing operation, electrical signals are sent from a printer controller to activate the energizing devices on the chip 52 to cause ink to be expelled through nozzle holes in the nozzle plate 54. In this regard, a demultiplexer is preferably provided on the chip 52 for demultiplexing incoming electrical signals and distributing them to the energizing devices on the chip 52.

In order to provide access to the chip 52 and traces on the circuit layer 58, openings are provided in each of the materials making up the printhead assembly as shown in FIG. 3A. There is a window or opening 92 in the nozzle plate 54 and adhesive 64 so that a wire 90 can be bonded to the silicon chip 52. The window depth is about 2 to 3 mils deep depending on the thickness of the nozzle plate 54 and adhesive 64.

In order to provide a relatively planar surface, the nozzle plate 54 may be extended over and bonded to the circuit layer 58 using an adhesive layer 96. A suitable adhesive for layer 96 may be selected from an acrylic based pressure sensitive adhesive such as AEROSET 1848. A window 98 is also preferably provided in the nozzle plate 54 and adhesive 96 so that wire 90 can be connected to the circuit layer 58 at electrical contact 88. Window 98 preferably has an overall depth of from about 6 to 10 mils depending on the thickness of the nozzle plate 54 and adhesive 96. The windows 92 and 98 in the nozzle plate 54 and in adhesives 64 and 96 may be formed as by a conventional photo-etching or laser ablation technique.

Because of the depth of windows 92 and 98, it is preferred to loop the wire 90 over the nozzle plate 54 in order to suitably connect wire 90 to chip 52 and circuit layer 58. A looped wire is preferred rather than providing a wire with no slack or loop in order to provide for expansion and contraction of the chip carrier 10 and/or chip 52 during printing operations without breaking wire 90 or overly stressing the wire 90 or wire connections thereby breaking the electrical connection between the circuit layer 58 and the chip 52.

Once the connections are made, the wire 90 and windows 98 and 92 are encapsulated in a elastomeric material such as a silicon polymer coating having a coefficient of thermal expansion greater than or equal to the wire 90. Other suitable elastomeric materials include, but are not limited to silicone, polyurethane and urethane acrylates such as UV 9000 available from Emerson & Cuming of Attleboro, Mass. Prior to coating the wire 90, it is preferred to depress the wire 90 downward toward the nozzle plate 54 in order to reduce the overall height of the loop of wire 90 above the top surface of the nozzle plate to below about 10 mils. Typically, the wire 90 has an undepressed height of from about 5 to about 15 mils above the top or outer surface of the nozzle plate 54. Thus, in accordance with the invention, the height of each loop is reduced by from about 50% to about 80%. Suitable apparatus for depressing the wire 90 to decrease the loop height is a wooden dowel having a diameter of from about 2 to about 5 millimeters and a length of from about 1 to about 10 centimeters. However, it is anticipated that suitable automated machinery may be used for this purpose.

Once the wire 90 is depressed so that a maximum loop height of about 5 mils above the top or outer surface of the nozzle plate 54 is obtained, the depressed wire 90 is preferably coated with the elastomeric material. Because the wire 90 has been depressed, a thinner coating of elastomeric material may be used to adequately cover the wire 90 and windows 92, 98, e.g., a coating of from about 4 to about 10 mils. The layer of elastomeric material is preferably no thicker than about 10 mils so that a maximum clearance of about 30 mils is maintained between the highest point on the printhead assembly and the print media.

Because of the walls 20, the circuit layer 58 (FIG. 2) does not come into contact with the ink. Thus, the circuit layer 58 does not have to be selected from materials which are relatively resistant to corrosion induced by the ink. Further, the traditional materials from which the circuit layer 58 is made may tend to contaminate the ink, such as by releasing fibers into the ink, which would reduce the reliability of the printhead. Therefore, the use of the walls 20 provides tremendous benefits to the printhead structure.

Referring again to FIG. 2, the height of the walls 20, is selected to be substantially equal to the thickness of the circuit layer 58 plus any adhesive used between the circuit layer 58 and carrier 10 and/or between the circuit layer 58 and nozzle plate 54. For a circuit layer 58 formed from a printed circuit board, this thickness is from about 20 mils to about 40 mils. For a flex circuit, this thickness is about 2 mils. Thus, the wall height is designed to be substantially equal to the thickness of the material that is to be used for the circuit layer 58.

As described above, the wall height preferably takes into account the additional thickness required for adhesives. By selecting a well depth and a wall height that are substantially equal to the thickness of the chip 52 and the circuit layer 58 respectively, the flow feature surface of the nozzle plate 54 and the top surface of circuit layer 58 are very close to the same level, which aids in fashioning the electrical connections between the circuit layer 58 and the chip 52.

FIG. 3B illustrates a preferred method for connecting the circuit layer 84' to a semiconductor chip 52. In this embodiment, TAB bonding is used to connect the circuit layer 84' to the chip 52 through windows 92' in the nozzle plate 54 and adhesive 64. The circuit layer 84' may be bonded to the chip carrier 10 by means of adhesive 67' as described above. In all other respects, the assembly of the circuit layer 84', nozzle plate 80' and chip 52 are generally as described above with reference to FIG. 3A.

Figure 4A:
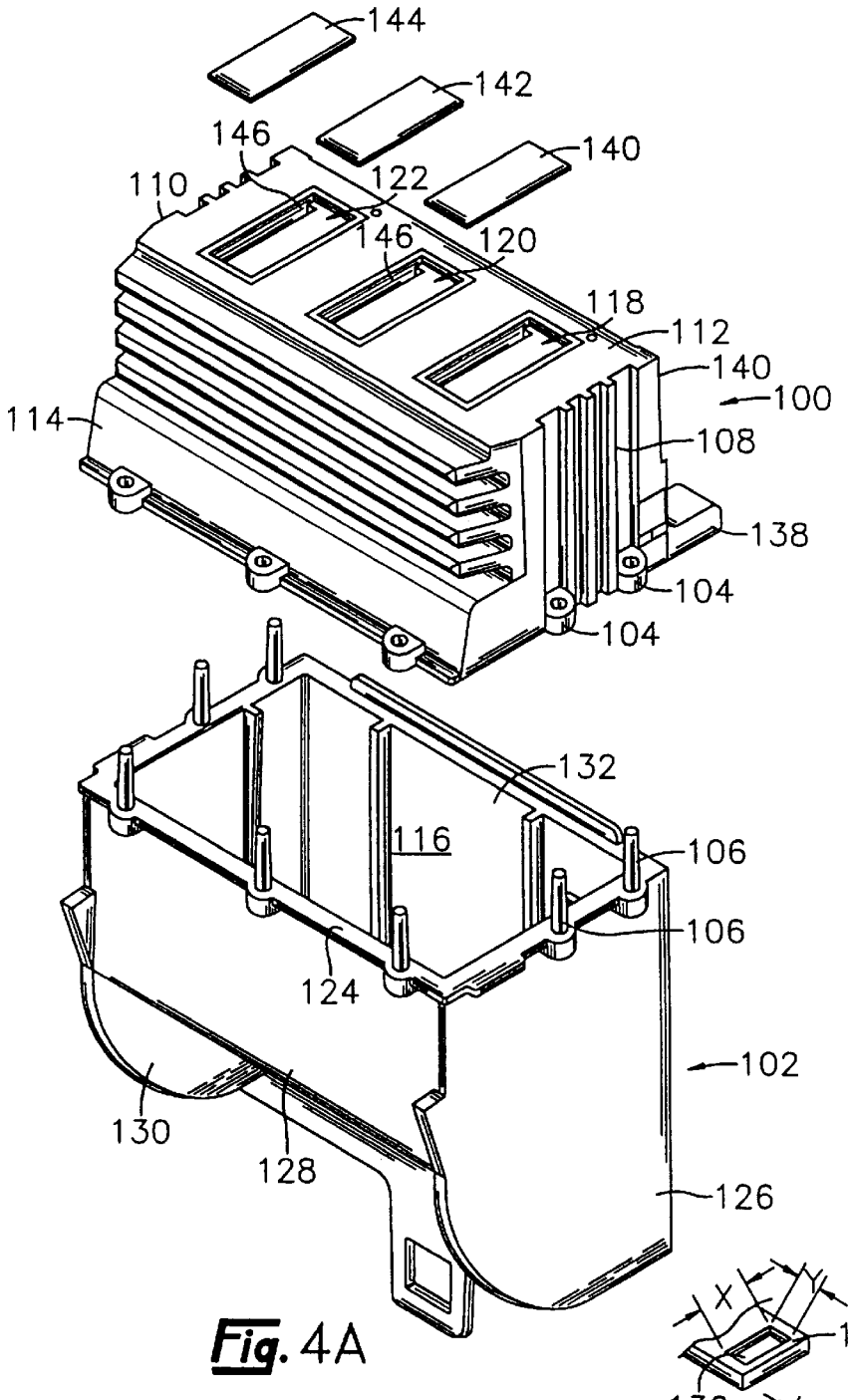
FIG. 4*a* is a print head cartridge assembly according to the invention.
Figure 4B:
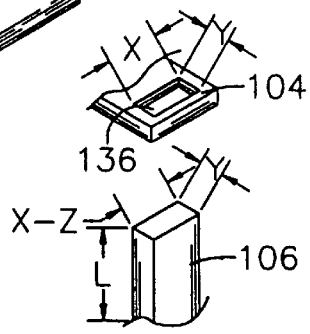
FIG. 4*b* is an alignment device for aligning a chip carrier to an ink reservoir according to the invention.

Referring now to FIGS. 4A and 4B, the chip carrier 100 is attached to an ink cartridge body or cartridge holder 102 which contains an ink supply source for feed of ink to chips in the wells 118, 120 and 122 of the carrier 100. In order to precisely control the location of the ink drop placement on a printed media, the carrier 100 should be mounted on the ink cartridge or cartridge holder body 102 within a tolerance of from about 5 to about 25 microns. Accordingly, the carrier 100 is provided with alignment slots or holes 104 which correspond to alignment tabs 106 pending from the cartridge body 102. At least one alignment device 104 containing a hole or slot is positioned on each of opposing side walls of the carrier 100 preferably toward the lower end of the side walls 108 and 110 opposite the end of the side walls attached to the top surface 112 of the carrier 100.

In FIG. 4A, carrier 100 contains two alignment devices 104 on each of side walls 108 and 110. Likewise, side wall 114 and the opposing side wall from side wall 114 may contain one or more alignment devices 104. Other projections, marks or slots may be used to align the carrier 100 and cartridge body 102 relative to one another.

The cartridge body or ink cartridge holder 102 is preferably made of a thermoplastic material such as high or low density polypropylene, polyethylene and the like. The body 102 has at least one open end wherein the body is attached to the carrier and may contain ink in liquid form or contain an ink saturated foam insert. The body 102 may have two open ends, one open end attached to the carrier 100 and an opposing open end for inserting into the body cavity 116 one or more ink cartridges, each of the cartridges containing ink or an ink saturated foam and being provided for supplying ink to each of the substrates in the ink wells 118, 120 and 122 of the carrier 100.

The slots or holes are precisely made in the alignment devices 104 of the carrier 100 to align with tabs or projections 106 which are adjacent the top perimeter 124 of the cartridge body walls 126, 128, 130 and 132 and the tabs 106 being preferably made of the same material as the holder 102. The tabs 106 are shown on the perimeter of three side walls 126, 128 and 130 of the cartridge holder 102 but may be on all four side walls or only on two opposing side walls along the top perimeter 124 of the cartridge body 102. It is preferred that the slots or holes in the alignment devices 104 be somewhat larger than the tabs or projections 106 in order to allow for adjustment of the carrier 100 relative to the body 102.

The shape of the tabs 106 and slots or holes is not critical to the invention provided mating shapes are used for both the tabs and the slots. Accordingly the tabs and slots may be circular, oval, round, square, rectangular, triangular, tapered or any other suitable shape. In FIG. 4B, alignment tab 106 is shown as a rectangular tab. When rectangular tabs are used, it is preferred to have the slots 136 in alignment device 104 slightly oversize in only one dimension and relatively the same size as the tabs in the other dimension so that tab 106 can only move in one direction in slot 136 and is relatively immovable in the other direction. For example, slot 136 may have a length x and a width y and tab 106 may have a length (x–z) and a width y which is substantially the same as width y of slot 136. In this example, tab 106 may move in slot 136 relative to the x dimension thereof and is substantially restrained from moving relative to the y dimension thereof By providing multiple alignment devices, 104 adjacent at least two opposing side walls of the carrier 100 and multiple tabs 106 along the perimeter 124 of the holder 102 corresponding to the alignment devices, precise alignment of the carrier 100 to the cartridge body 102 may be obtained.

The tabs 106 are preferably made of the same material as the body 102, most preferably a thermoplastic material, and each tab 106 preferably has a length L which is sufficient to allow a portion of the tab to extend above the alignment device 104 when tab 106 is fully mated with its corresponding slot 136 and the carrier 100 is adjacent the perimeter 124 of the body 102. Once the carrier 100 is precisely aligned to the body 102, the ends of the tabs 106 are deformed as by melting to fixedly attach the carrier 100 to the body 102. The tabs 106 may be melted by using a heat stake, hot upset tooling or hot air-cold stake tooling which is positioned adjacent the sides of the carrier 100 containing the alignment devices 104. Once the tabs 106 are melted, a substantially permanent connection is made between the carrier 100 and cartridge holder 102.

Other means for fixedly attaching the carrier 100 to the cartridge body 102 may be used in lieu of or in addition to the alignment devices 104 and tabs 106 described above. Such other means include adhesives and fasteners such as bolts and screws. However, regardless of the attachment means, it is preferred to have a plurality of alignment devices 104 on the carrier 100 and a plurality of tabs 106 on the body 102 so that precise alignment between the parts can be obtained.

Another feature of the carrier 100 according to the invention is the carriage positioning devices 138 attached to the carrier 100 adjacent at least one side 140 thereof (FIG. 4A). The carriage positioning devices 138 accurately align the substrate carrier 100 to the printer carriage thus effectively aligning the semiconductor chips 140, 142 and 144 which are attached to the carrier 100 with the printer carriage so that the precise location of each nozzle hole in nozzle plates attached to the substrates is maintained as the carrier 100 and cartridge body 102 are attached and removed from the printer carriage. The printer carriage functions to move the printhead structure in a desired manner across the paper as ink is ejected from the printhead. Accordingly, proper alignment of the printhead structure relative to the printer carriage is important for high quality printing of images on a print media.

During a printing operation ink flows from the ink reservoir in the cartridge body 102 through the slots 146 in the carrier and into the wells 118, 120 and 122. From the wells, the ink is supplied to the flow features in the nozzle plates where it contacts the energizers on the chips 140, 142 and 144. When the energizers receive a signal, as described above, the ink is ejected through the nozzle holes toward the print media. As described above, rapid firing of the energizers and an increased number of energizers within a given area of the top surface of the chip both of which are desirable goals, tends to cause warming of the ink and the chip. This warming can degrade the performance of the printer.

Using the printhead as described above provides for several different paths for heat dissipation so that the ink is not overheated. For example, the heat can transfer from either the ink or the chip to the nozzle plate, and from the nozzle plate the heat can be dissipated to the air. The adhesive used to attach the chip to the carrier preferably has a relatively high thermal conductivity to aid in the transfer of heat from the chip to the carrier through the bonding surface on the carrier. From the carrier, heat is dissipated to the air as by the use of cooling fins on the carrier.

Finally, the ink itself can aid in cooling the chip by receiving heat from the chip. The ink removes heat from the chip by flowing over the sides of the chip as the ink flows from the reservoir through the slots to the well containing the chips. Using the ink to cool the chip is entirely counter-intuitive, as it is an express design goal to keep the ink from overheating. However, the well and well walls provide a relatively large surface area for receiving heat from the ink. Thus, the walls, base and nozzle plate, all receive heat from the ink, thereby reducing the tendency of the ink to become overheated. A printhead as described is thus able to provide many of the design goals of having high energizer firing, high energizer placement density; use of standard printhead components reduced corrosion, increased heat dissipation from the printhead and simplified manufacturing techniques.

Having described various aspects and embodiments of the invention and several advantages thereof, it will be recognized that the invention by those of ordinary skills susceptible to various modifications, substitutions and revisions within the spirit and scope of the appended claims.

I claim:

1. A carrier for an ink jet print head, the carrier having top and bottom surfaces, the carrier being adapted to receive a chip having a thickness and a circuit layer having a thickness, the carrier comprising:

at least one well having a base and walls attached thereto surrounding the base, the walls extending above the top surface of the carrier to a wall height substantially equal to the thickness of a circuit layer which is attached to the top surface of the carrier, and the well having a well depth substantially equal to the thickness of a chip which is attached to the base of each well, and a slot formed in the base of the well and extending from the bottom surface of the carrier to the base.

2. The carrier of claim 1 wherein the carrier comprises a material that is substantially resistant to ink induced corrosion.

3. The carrier of claim 1 wherein the carrier comprises a material that is substantially resistant to an adhesive curing temperature used to attached the chip to the carrier and a nozzle plate to the chip.

4. The carrier of claim 1 wherein the carrier comprises a material selected from the group consisting of a metal matrix composite, a polymer matrix composite, and a metal.

5. The carrier of claim 1 further comprising an adhesive surface disposed at the base of the well for receiving the chip and the slot disposed in a portion of the base that is adjacent the adhesive surface of the base.

6. The carrier of claim 1 further comprising an adhesive surface disposed at the base of the well for receiving the chip and the slot disposed in a portion of the base that is through a portion of the adhesive surface of the base.

7. The carrier of claim 1 further comprising a corrosion resistant material coated thereon.

8. The carrier of claim 7 wherein the corrosion resistant material is a poly(xylelene).

9. The carrier of claim 7 wherein the corrosion resistant material is silicon dioxide.

10. An ink jet print head structure, comprising:

a semiconductor chip having a thickness, a device surface and a carrier attachment surface opposite the device surface, a circuit layer having a thickness, a bottom surface and a top surface opposite the bottom surface and containing traces and contacts for making electrical connections to the circuit layer, a substrate carrier having a substrate surface, ink supply surface opposite the substrate surface and at least one well in the substrate surface having a base with an adhesive surface for attaching the semiconductor chip thereto and walls surrounding the base, the walls extending above the substrate surface of the carrier to a wall height substantially equal to the thickness of the circuit layer, the well having a well depth substantially equal to the thickness of the semiconductor chip, a slot in the base of the well extending from the ink supply surface of the carrier to a portion of the base adjacent the adhesive surface of the base, the chip being disposed in the well and being attached to the adhesive surface of the base, the circuit layer being disposed adjacent the substrate surface of the carrier, and a nozzle plate disposed adjacent the walls and the device surface of the chip, the nozzle plate having nozzles axially aligned with the chip.

11. The printhead structure of claim 10 wherein the carrier comprises a material that is substantially resistant to ink induced corrosion.

12. The printhead structure of claim 10 wherein the carrier comprises a material that is substantially resistant to an adhesive curing temperature.

13. The printhead structure of claim 10 wherein the carrier comprises a material selected from the group consisting of a metal matrix composite, a polymer matrix composite, and a metal.

14. The printhead structure of claim 10 wherein the chip is attached to the base of the well.

15. The printhead structure of claim 10 wherein the carrier further comprises cooling fins for convective heat transfer from the carrier.

16. A method of forming an ink jet printhead, comprising:

providing a semiconductor chip having a thickness, a carrier attachment surface, a device surface opposite the attachment surface, energizers disposed on the device surface thereof and electrical traces from the energizes to contact pads on the device surface;

providing a circuit layer having a thickness, a bottom surface, a top surface, and contacts for making electrical connections to the circuit layer;

forming a nozzle plate from a nozzle plate material, the nozzle plate having a flow feature surface, a print media surface opposite the flow feature surface and nozzle holes extending from the flow feature surface to the print media surface;

forming a substrate carrier from a heat conductive material, the carrier having an ink supply surface, a substrate surface opposite the ink supply surface and at least one well in the substrate surface having a base with an adhesive surface for attaching the semiconductor chip thereto and walls surrounding the base, the walls extending above the substrate surface of the carrier to a wall height substantially equal to the thickness of the circuit layer attached to the substrate surface of the carrier, and the well having a well depth substantially equal to the thickness of the semiconductor chip, wherein the base of the well contains a slot formed therein and extending from the ink supply surface of the carrier to a portion of the base adjacent the adhesive surface for a side feed configuration and through a portion of the adhesive surface of the base for a center feed configuration, aligning the energizers disposed on the device surface of the chip with the nozzles holes of the nozzle plate, fixedly attaching the device surface of the chip to the flow feature surface of the nozzle plate, fixedly attaching the carrier attachment surface of the chip to the adhesive surface of the base, attaching the flow feature surface of the nozzle plate to the walls of the well so that the chip is bonded to the base of the well, attaching the bottom surface of the circuit layer to the substrate surface of the carrier, and electrically connecting the contacts on the circuit layer to the contact pads on the chip.

17. The method of claim 16 wherein the chip is fixedly attached to the base using a thermally conductive adhesive.

18. The method of claim 17 wherein the nozzle plate is fixedly attached to the chip using a B-stageable adhesive.

19. The method of claim 18 wherein the B-stageable adhesive is cured prior to attaching the circuit layer to the carrier.

20. The method of claim 16 wherein the energizers comprise resistance elements.

21. The method of claim 16 wherein the chip, nozzle plate and carrier comprise materials that are substantially resistant to ink induced corrosion.

22. The method of claim 16 wherein the chip, the nozzle plate and carrier comprise materials that are substantially resistant to an adhesive curing temperature.

23. The method of claim 16 wherein the carrier comprises a material selected from the group consisting of a metal matrix composite, a polymer matrix composite, and a metal.

24. The method of claim 16 further comprising coating the carrier with a corrosion resistant material prior to attaching the chip and nozzle plate to the carrier.

25. The method of claim 24 wherein the corrosion resistant material is comprised of poly(xylelene).

26. The method of claim 24 wherein the corrosion resistant material is comprised of silicon dioxide.

* * * * *